US011602933B2

(12) United States Patent
Wong et al.

(10) Patent No.: US 11,602,933 B2
(45) Date of Patent: Mar. 14, 2023

(54) LIQUID EJECTION HEAD AND LIQUID EJECTION APPARATUS

(71) Applicant: TOSHIBA TEC KABUSHIKI KAISHA, Tokyo (JP)

(72) Inventors: Mengfei Wong, Mishima Shizuoka (JP); Ryutaro Kusunoki, Mishima Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 66 days.

(21) Appl. No.: 17/191,524

(22) Filed: Mar. 3, 2021

(65) Prior Publication Data

US 2021/0354452 A1 Nov. 18, 2021

(30) Foreign Application Priority Data

May 15, 2020 (JP) ..... JP2020-086106

(51) Int. Cl.
*B41J 2/045* (2006.01)
*B41J 2/14* (2006.01)

(52) U.S. Cl.
CPC ..... *B41J 2/04588* (2013.01); *B41J 2/04541* (2013.01); *B41J 2/04581* (2013.01); *B41J 2/04595* (2013.01); *B41J 2/04596* (2013.01); *B41J 2/14298* (2013.01)

(58) Field of Classification Search
CPC ..... B41J 2/04595
See application file for complete search history.

(56) References Cited

U.S. PATENT DOCUMENTS

| | | | | |
|---|---|---|---|---|
| 6,488,349 | B1 | 12/2002 | Matsuo et al. | |
| 7,661,785 | B2 | 2/2010 | Norigoe | |
| 8,801,128 | B2 | 8/2014 | Tsukamoto | |
| 9,694,577 | B2 | 7/2017 | Nitta et al. | |
| 9,950,521 | B2 | 4/2018 | Nitta et al. | |
| 2006/0284911 | A1* | 12/2006 | Norigoe | B41J 2/04588 347/11 |
| 2009/0213156 | A1* | 8/2009 | Okada | B41J 2/04596 347/13 |

(Continued)

FOREIGN PATENT DOCUMENTS

| | | | |
|---|---|---|---|
| CN | 1541841 | A | 11/2004 |
| CN | 102649358 | A | 8/2012 |

(Continued)

OTHER PUBLICATIONS

U.S. Appl. No. 16/921,853, filed Jul. 6, 2020.

*Primary Examiner* — Shelby L Fidler
(74) *Attorney, Agent, or Firm* — Kim & Stewart LLP

(57) ABSTRACT

According to one embodiment, a liquid ejection head includes a pressure chamber that contains a liquid, an actuator to change the pressure in the pressure chamber according to an applied drive signal, and a drive circuit to apply a first drive signal to the actuator when a single droplet is to be ejected from the pressure chamber and a second drive signal to the actuator when two or more droplets are to be ejected in series from the pressure chamber. The first drive signal has a first auxiliary pulse before a first ejection pulse. The second drive signal has a second auxiliary pulse before the first ejection pulse. A pulse width of the first auxiliary pulse is greater than a pulse width of the second auxiliary pulse.

20 Claims, 10 Drawing Sheets

(56) References Cited

U.S. PATENT DOCUMENTS

| | | | | |
|---|---|---|---|---|
| 2012/0218333 | A1 | 8/2012 | Nishikawa | |
| 2015/0298455 | A1* | 10/2015 | Shimoda | B41J 2/04595 347/10 |
| 2017/0008280 | A1* | 1/2017 | Nitta | B41J 2/04588 |

FOREIGN PATENT DOCUMENTS

| | | | |
|---|---|---|---|
| CN | 106335279 | A | 1/2017 |
| CN | 106457823 | A | 2/2017 |
| JP | 2007022073 | A | 2/2007 |
| JP | 2013078863 | A | 5/2013 |
| JP | 2017013487 | A | 1/2017 |

* cited by examiner

LIQUID EJECTION HEAD AND LIQUID EJECTION APPARATUS

CROSS-REFERENCE TO RELATED APPLICATION

This application is based upon and claims the benefit of priority from Japanese Patent Application No. 2020-086106, filed on May 15, 2020, the entire contents of which are incorporated herein by reference.

FIELD

Embodiments described herein relate generally to a liquid ejection head and a liquid ejection apparatus.

BACKGROUND

An on-demand type ink jet printing method in which an ink droplet is ejected from a nozzle according to an image signal to print an image with ink droplets on a sheet of paper or the like is known. In such an ink jet printing method, gradation in an image can be formed by the number of ink droplets that are ejected in series. An ink jet printer is a type of liquid ejection apparatus that mounts an ink jet head, which is a type of liquid ejection head, that uses the on-demand type ink jet printing method. An ink jet printer, for example, ejects ink of different colors such as cyan, magenta, yellow, and black from a plurality of ink jet heads, and forms an image on the paper according to an image signal that is supplied thereto.

Ink jet heads using the on-demand type ink jet printing method usually comprise a heating element type head or a piezoelectric element type head. The heating element type head is configured such that a heating element in an ink flow path can be energized to generate bubbles in the ink and the ink is pushed by the bubbles and ejected from a nozzle. The piezoelectric element type head is configured to eject ink from an ink chamber through a nozzle by utilizing deformation of a piezoelectric element.

For a piezoelectric element type ink jet head, a configuration using a drive element substrate formed of a piezoelectric material is known. Such an ink jet head is configured to include, for example, an ink supply port, an ink supply member, an ink pressure chamber, an actuator substrate, and a drive integrated circuit (IC) (referred to as a "drive circuit" or a "drive IC"). On one end of the ink pressure chamber, a diaphragm to which a drive element is attached is present. A nozzle for ejecting ink is formed on the diaphragm. In such an ink jet head, the diaphragm is deformed by using the drive element and the ink is ejected by a change in pressure in the ink pressure chamber.

The drive IC causes an ink droplet to be ejected from the nozzle by applying a drive signal (drive waveform) including an expansion pulse and a contraction pulse to an actuator. With respect to such a drive signal, there is known a method of increasing an ejection speed of the ink by applying a small, auxiliary pulse before the expansion pulse and the contraction pulse, which cause the ink droplet to be ejected from the nozzle.

In general, when the number of drops that are ejected in series is large, a droplet that ejects later typically merges with previously ejected droplets, and thus there is no problem even if the speed of the ink that is ejected first is slow. Hysteresis of the actuator has almost no influence on ink ejection for the second and subsequent drops. Accordingly, in order to increase a drive frequency, the auxiliary pulse is not required when ejecting two or more drops in series (back-to-back).

However, in a control method in which an auxiliary pulse is added only when ejecting just a single drop and the auxiliary pulse is not inserted when ejecting two or more drops in series, only the drive voltage can be controlled for the ejection of the two or more drops. There is a limit to adjustment of pressure vibration of ink only by controlling the drive voltage, and stable ejection may not always be obtained. There may be large variations in the ejection speed for each gradation depending on a drive signal, a type of ink, a shape of the pressure chamber, and the like. When variations in the ejection speed for each gradation increase, printing accuracy decreases.

DETAILED DESCRIPTION

Figure 1:
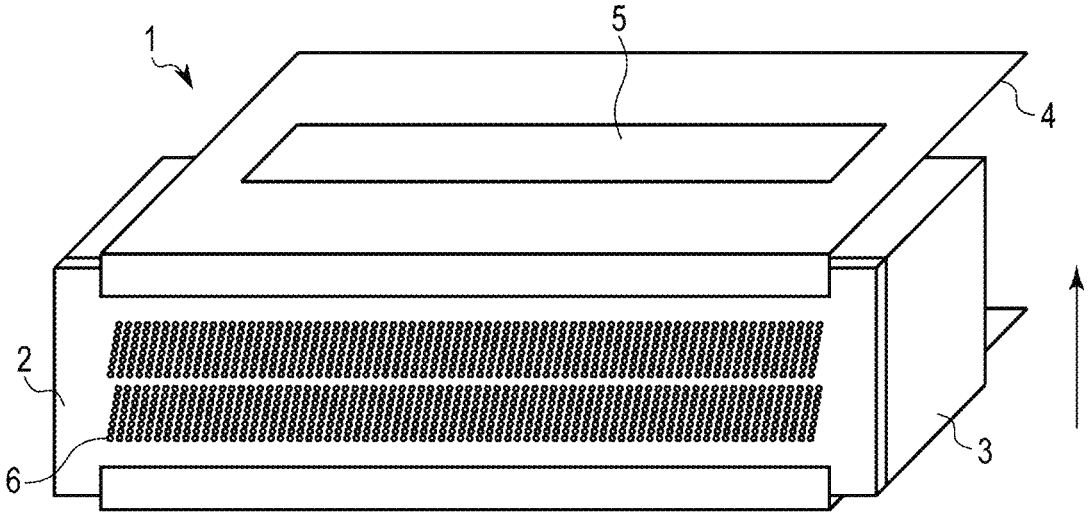
FIG. 1 is a perspective view illustrating an outer appearance of an ink jet head according to an embodiment.

Embodiments provide a liquid ejection head and a liquid ejection apparatus capable of reducing variations in the ejection speed for different gradation values related to the number of ejected ink droplets or the like.

In general, according to one embodiment, a liquid ejection head includes a pressure chamber that is configured to contain a liquid, an actuator configured to change the pressure of the pressure chamber according to an applied drive signal, and a drive circuit. The drive circuit is configured to apply a first drive signal to the actuator when a single droplet is to be ejected from the pressure chamber and a second drive signal to the actuator when two or more droplets are to be ejected in series from the pressure chamber. The first drive signal has a first auxiliary pulse before a first ejection pulse. The second drive signal has a second auxiliary pulse before the first ejection pulse. A pulse width of the first auxiliary pulse is greater than a pulse width of the second auxiliary pulse.

Hereinafter, an ink jet head according to an embodiment and an ink jet printing apparatus incorporating an ink jet head will be described with reference to the drawings. In the drawings, the depicted scale of each part may be changed as appropriate. Certain components or aspect may be omitted from drawings for the sake of description. In the drawings and the specification, the same reference numerals denote the same elements.

FIG. 1 is a perspective view illustrating an outer appearance of an ink jet head 1 according to an embodiment.

The ink jet head 1 includes a flow path substrate 2, an ink supply unit 3, a flexible wiring board 4, and a drive circuit 5. The ink jet head 1 is an example of a liquid ejection head.

On the flow path substrate 2, actuators 6 each of which is provided with a nozzle 19 (see FIG. 3) for ejecting liquid such as ink are arranged in an array. The nozzles 19 do not overlap each other in a printing direction, and are arranged at equal intervals in a direction orthogonal to the printing direction. Each of the actuator 6 is electrically connected to the drive circuit 5 via the flexible wiring board 4. The drive circuit 5 is electrically connected to a control circuit that controls printing. The flow path substrate 2 and the flexible wiring board 4 are joined and electrically connected to one another by an anisotropic conductive film (ACF). The flexible wiring board 4 and the drive circuit 5 are joined and electrically connected to one another by, for example, a chip-on-flex (COF) type flexible circuit substrate or the like.

The ink supply unit 3 is joined to the flow path substrate 2 by, for example, an epoxy-based adhesive or the like. The ink supply unit 3 includes an ink supply port connected to a liquid supply device 111 (see FIG. 5) via a tube or the like, and supplies the ink from the ink supply port to the flow path substrate 2. The pressure of the ink to be supplied to the ink supply port is desirably lower than the atmospheric pressure by approximately 1000 [Pa]. The ink supplied from the ink supply port fills a pressure chamber 20 and the nozzle 19 while the pressure of the ink in the pressure chamber 20 is maintained at a pressure lower than the atmospheric pressure by approximately 1000 Pa while waiting for ejection of ink.

The drive circuit 5 generates a control signal and a drive signal for operating each actuator 6. The drive circuit 5 generates a control signal for control such as selecting a timing for ejecting ink and the actuator 6 for ejecting ink according to an image signal for printing, input from the outside of the ink jet printing apparatus 100. The drive circuit 5 also generates a voltage to be applied to the actuator 6, that is, a drive signal (electrical signal) according to the control signal. When the drive circuit 5 applies the drive signal to the actuator 6, the actuator 6 moves to change a volume of the pressure chamber 20 (see FIG. 3) inside the flow path substrate 2. With such a configuration, the ink in the pressure chamber 20 causes a pressure vibration. Due to the pressure vibration, the ink is ejected from the nozzle 19 in a direction normal to the surface of the flow path substrate 2. The ink jet head 1 realizes gradations in color by changing an amount of ink landed on one pixel. The inkjet head 1 changes the amount of ink landed on one pixel by changing the number of ink droplets ejected for the pixel. As described above, the drive circuit 5 is an example of an application unit that applies a drive signal to the actuator 6.

Figure 2:
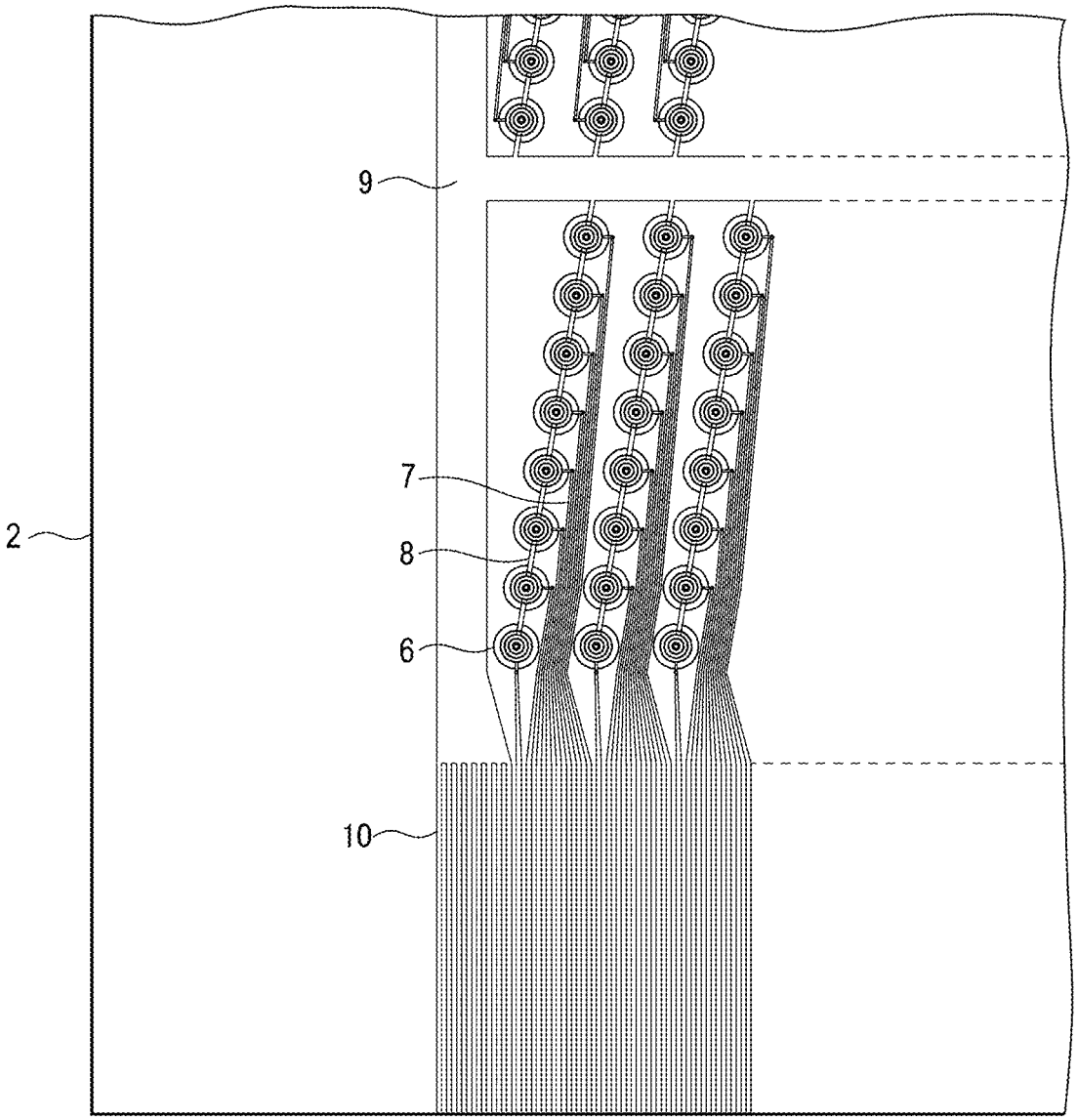
FIG. 2 is a plan view illustrating certain details of a flow path substrate.

FIG. 2 is a plan view illustrating details of the flow path substrate 2. However, in FIG. 2, illustration is made with the repeated parts of the same pattern omitted.

A large number of actuators 6, a large number of individual electrodes 7, a large number of common electrodes 8, a large number of common electrodes 9, and a large number of mounting pads 10 are formed on the flow path substrate 2.

The individual electrodes 7 electrically connect the respective actuators 6 and the mounting pads 10. The individual electrodes 7 are electrically independent from each other.

The common electrodes 8 branch from the common electrodes 9 and are electrically connected to the actuators 6. The common electrodes 9 are electrically connected to the mounting pads 10 at an end. The common electrodes 8 and the common electrodes 9 are electrically shared (connected in common) between the plurality of actuators 6.

The mounting pads 10 are electrically connected to the drive circuit 5 via a large number of wiring patterns formed on the flexible wiring board 4. An anisotropic conductive film (ACF) can be used for connecting the mounting pads 10 and the flexible wiring board 4. Alternatively, the mounting pads 10 may be connected to the drive circuit 5 by a method such as wire bonding.

Figure 3:
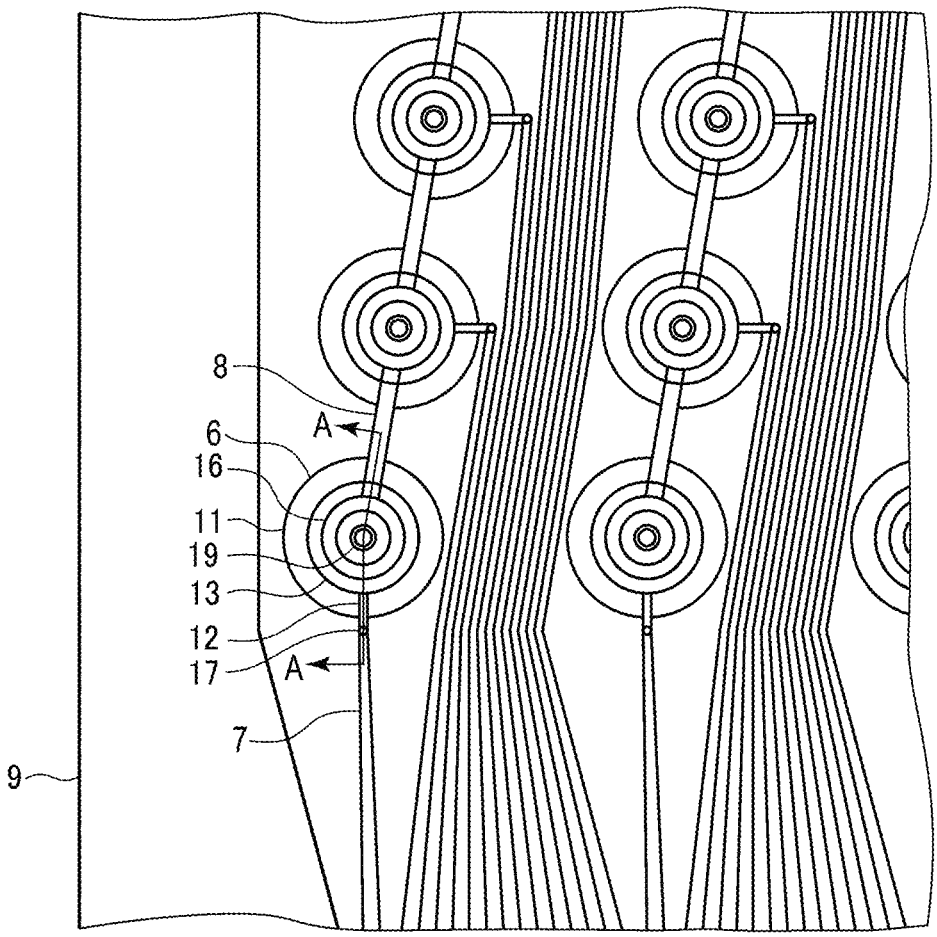
FIG. 3 is a plan view illustrating certain details of an actuator and a periphery thereof.
Figure 4:
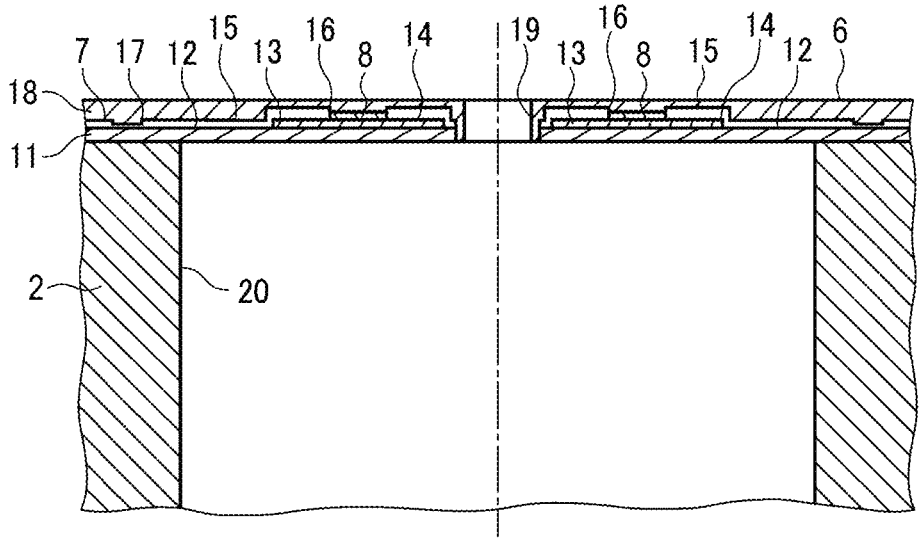
FIG. 4 is a cross-sectional view taken along line A-A of FIG. 3.

FIG. 3 is a plan view illustrating details of each actuator 6 and a periphery thereof. FIG. 4 is a cross-sectional view taken along a line A-A of FIG. 3.

Each actuator 6 is configured to include a common electrode 8, a diaphragm 11, a lower electrode 12, a piezoelectric body 13, an upper electrode 14, an insulating layer 15, a protective layer 18, and the nozzle 19. The lower electrode 12 is electrically connected to the individual electrode 7.

The flow channel substrate 2 is formed from, for example, a single crystal silicon wafer having a thickness of 500 μm. Inside the flow path substrate 2, the pressure chambers 20 to be filled with ink are formed. The diameter of a pressure chamber 20 is, for example, 200 μm. A pressure chamber 20 is formed, for example, by making a hole in the lower surface of the flow path substrate 2 by a dry etching process.

The diaphragm 11 is integrally formed with the flow path substrate 2 to cover the upper surface of the pressure chamber 20. The thickness of the diaphragm 11 is, for example, 2 to 10 μm, preferably 4 to 6 μm. The diaphragm 11 is, for example, an insulating inorganic material such as silicon dioxide. The diaphragm 11 can be formed of silicon dioxide by heating the silicon flow path substrate 2 at a high temperature before forming the pressure chamber 20, for example. A through-hole larger than the nozzle 19 is formed in the diaphragm 11 concentrically with the nozzle 19. The thickness of the diaphragm 11 is 4 μm, for example.

On the diaphragm 11, the lower electrode 12, the piezoelectric body 13, and the upper electrode 14 are formed in a donut shape around the nozzle 19. The inner diameter is, for example, 30 μm. The outer diameter is 140 μm, for example. The lower electrode 12 and the upper electrode 14 are formed by depositing platinum or the like by a sputtering method or the like, for example. The piezoelectric body 13 is formed by depositing PZT ($Pb(Zr,Ti)O_3$) (lead zirconate titanate) or the like by a sputtering method or a sol-gel method. The thickness of the upper electrode 14 and the thickness of the lower electrode 12 are each about 0.1 to 0.2 μm, for example. The thickness of the PZT is 2 μm, for example.

When a positive voltage is applied to each actuator 6 and an electric field is generated in the thickness direction of the piezoelectric body 13, the piezoelectric body 13 is deformed in a d31 mode. That is, the piezoelectric body 13 contracts in the direction orthogonal to the thickness direction when a positive voltage is applied to the actuator 6. Due to the contraction, compressive stress is generated in the diaphragm 11 and the protective layer 18. Here, since Young's modulus of the diaphragm 11 is larger than Young's modulus of the protective layer 18, the compressive force generated on the diaphragm 11 exceeds the compressive force generated on the protective layer 18. Therefore, the actuator 6 bends in the direction of the pressure chamber 20 when the positive voltage is applied. With such configuration, the volume of the pressure chamber 20 becomes smaller than when no voltage is applied to the actuator 6. That is, the larger the value of the voltage of the drive signal applied to the actuator 6, the smaller the volume of the pressure chamber 20. Then, when application of the voltage to the piezoelectric body 13 is stopped, deformation of the piezoelectric body 13 is reversed. Due to the reversible deformation, the volume of the pressure chamber 20 expands and contracts. When the volume of the pressure chamber 20 changes, ink pressure in the pressure chamber 20 varies.

The insulating layer 15 is formed on the upper surface of the upper electrode 14. A contact hole 16 and a contact hole 17 are formed in the insulating layer 15. The contact hole 16 is a donut-shaped (annular) opening, and the upper electrode 14 and the common electrode 8 are electrically connected. The contact hole 17 is a circular opening, and the lower electrode 12 and the individual electrode 7 are electrically connected to each other. The insulating layer 15 is formed by depositing silicon dioxide by a tetraethoxysilane (TEOS)-chemical vapor deposition (CVD) method, for example. The insulating layer 15 has a thickness of 0.5 μm, for example. The insulating layer 15 prevents the common electrode 8 and the lower electrode 12 from electrically contacting each other on the outer peripheral portion of the piezoelectric body 13.

On the upper surface of the insulating layer 15, the individual electrode 7, the common electrode 8 and the mounting pad 10 are formed. The individual electrode 7 and the common electrode 8 are connected to the lower electrode 12 and the upper electrode 14 via the contact holes 17 and 16, respectively. The individual electrode 7 may be connected to the upper electrode 14. The common electrode 8 may be connected to the lower electrode 12. The individual electrode 7, the common electrode 8, and the mounting pad 10 are formed by forming a gold film by a sputtering method, for example. The thickness of the individual electrode 7, the common electrode 8, and the mounting pad 10 is, for example, 0.1 μm to 0.5 μm.

The protective layer 18 is formed on the individual electrode 7, the common electrode 8, and the insulating layer 15. The protective layer 18 is, for example, a film of a photosensitive polyimide material formed by a spin coating method. The thickness of the protective layer 18 is, for example, 4 μm. Each nozzle 19 communicating with a pressure chamber 20 is opened in the protective layer 18.

The nozzle 19 is formed, for example, by exposing and developing the photosensitive polyimide material forming the protective layer 18. The diameter of the nozzle 19 is, for example, 20 μm. The length of the nozzle 19 is determined by the total thickness of the diaphragm 11 and the protective layer 18. The length of the nozzle 19 is, for example, 8 μm.

Figure 5:
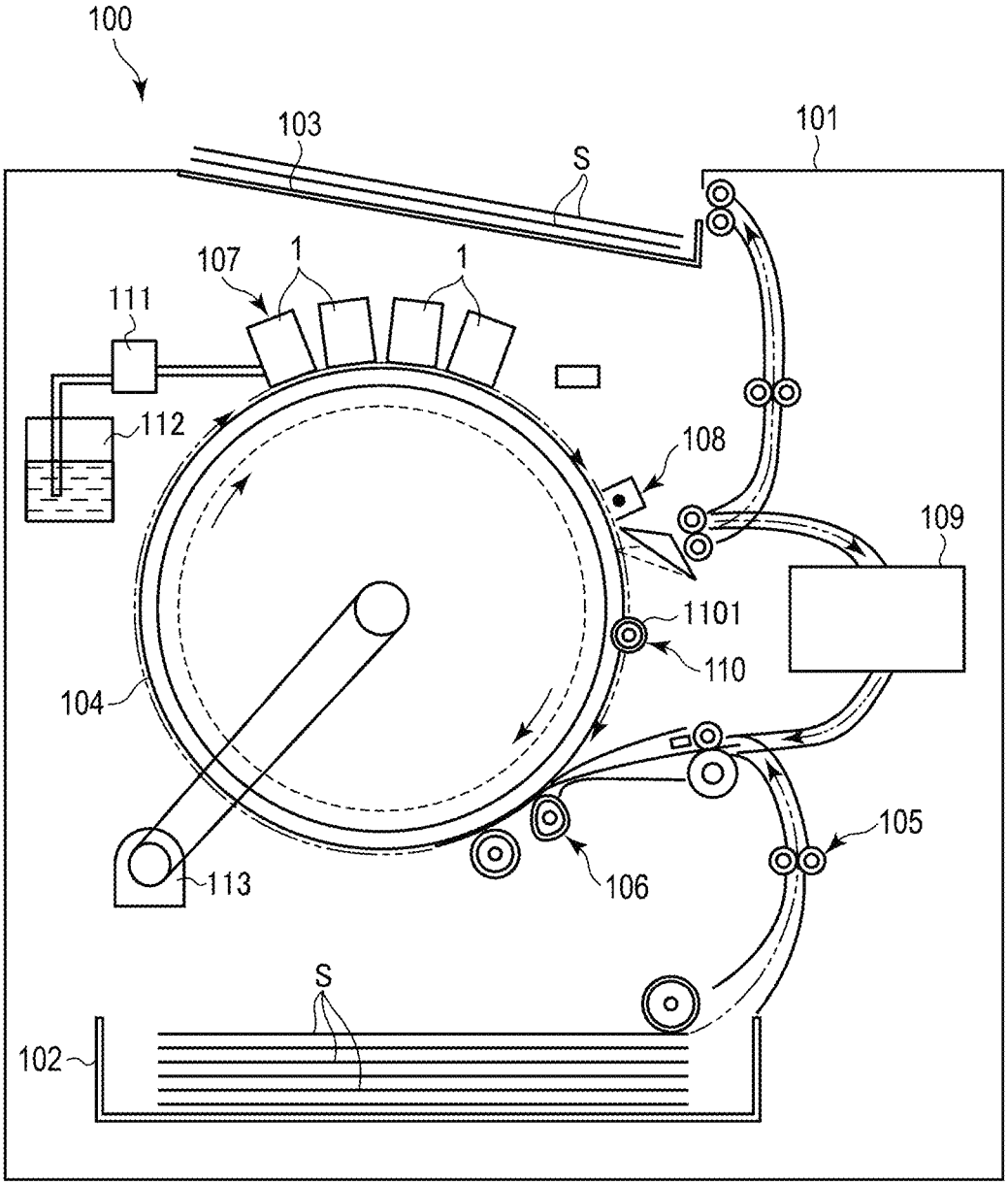
FIG. 5 is a schematic diagram illustrating an ink jet printing apparatus according to an embodiment.

Next, the ink jet printing apparatus 100 including the ink jet head 1 will be described. FIG. 5 is a schematic diagram illustrating an example of the ink jet printing apparatus 100. The ink jet printing apparatus 100 can also be referred to as an ink jet printer or an ink jet recording apparatus. The ink jet printing apparatus 100 may be an apparatus such as a copying machine in some examples. The ink jet printing apparatus 100 is a liquid ejection apparatus.

The ink jet printing apparatus 100 performs various kinds of processing related to image formation while conveying an image forming medium S. The image forming medium S is, for example, a sheet of paper. The ink jet printing apparatus 100 includes a casing 101, a paper feed cassette 102, a paper discharge tray 103, a holding roller (drum) 104, a conveyance device 105, a holding device 106, an image forming device 107, a neutralizing and separating device 108, a reversing device 109, a cleaning device 110, a liquid supply device 111, and a liquid tank 112.

The casing 101 accommodates therein each sub-unit or component of the ink jet printing apparatus 100.

The paper feed cassette 102 is inside the casing 101 and can store image forming media S.

The paper discharge tray 103 is on the upper part of the casing 101. The paper discharge tray 103 is a discharge destination for the image forming medium S after an image is formed thereon by the ink jet printing apparatus 100.

The holding roller 104 includes a cylindrical conductor and a thin insulating layer formed on the surface of the cylindrical conductor. The cylindrical conductor is grounded (ground-connected). The holding roller 104 conveys the image forming medium S by rotating while holding the image forming medium S on its surface.

The conveyance device 105 includes a plurality of guides and a plurality of conveyance rollers arranged along a conveyance path of the image forming medium S. The conveyance rollers are driven to rotate by a motor. The conveyance device 105 conveys the image forming medium S along the conveyance path from the paper feed cassette 102 to the paper discharge tray 103.

The holding device 106 attracts and holds the image forming medium S on the surface (outer peripheral surface) of the holding roller 104. The holding device 106 presses the image forming medium S against the holding roller 104 and then causes the image forming medium S to be attracted to the holding roller 104 by electrostatic force due to charging.

The image forming apparatus 107 forms an image on the image forming medium S as it is held by the holding device 106 on the surface of the holding roller 104. The image forming apparatus 107 includes a plurality of ink jet heads 1 facing the surface of the holding roller 104. The plurality of ink jet heads 1 form an image on the surface of the image forming medium S by ejecting, for example, four color inks of cyan, magenta, yellow, and black onto the image forming medium S according to the image signal. The ink jet heads 1 eject different inks but have the same structure.

The neutralizing and separating device 108 neutralizes accumulated charge on the image forming medium S after an image has been formed, thereby permitting the printed image forming medium S to separate from the holding roller 104. The neutralizing and separating device 108 neutralizes accumulated charge on the image forming medium S by supplying electric charge, and then inserts a claw between the image forming medium S and the holding roller 104. By such configuration, the image forming medium S is separated from the holding roller 104. The conveyance device 105 conveys then the image forming medium S separated from the holding roller 104 to the paper discharge tray 103 or the reversing device 109.

The reversing device 109 reverses the front and back surfaces of the image forming medium S, and supplies the image forming medium S back to the holding roller 104 to permit printing on the reverse (back) side of the image forming medium S. The reversing device 109 reverses the image forming medium. S, for example, by conveying the image forming medium S along a predetermined reversing path for switching back the image forming medium S in the front-rear direction.

The cleaning device 110 cleans the holding roller 104. The cleaning device 110 includes a cleaning member 1101. The cleaning device 110 is located downstream of the neutralizing and separating device 108 in the rotation direction of the holding roller 104. The cleaning device 110 makes the cleaning member 1101 rub against the surface of the rotating holding roller 104 to clean the surface of the rotating holding roller 104.

The liquid supply apparatus 111 includes a pump and a pressure adjusting mechanism. The liquid supply device 111 supplies the ink from the liquid tank 112 to the ink jet head 1 by the pump. The liquid supply device 111 is an example of a liquid supply device that supplies ink to the pressure chambers 20.

The liquid tank 112 stores ink to be supplied to the ink jet head 1. Only one liquid supply device 111 and one liquid tank 112 are illustrated in FIG. 5; however, generally, the ink jet printing apparatus 100 includes a liquid supply device 111 and a liquid tank 112 for each ink jet head 1.

Figure 6:
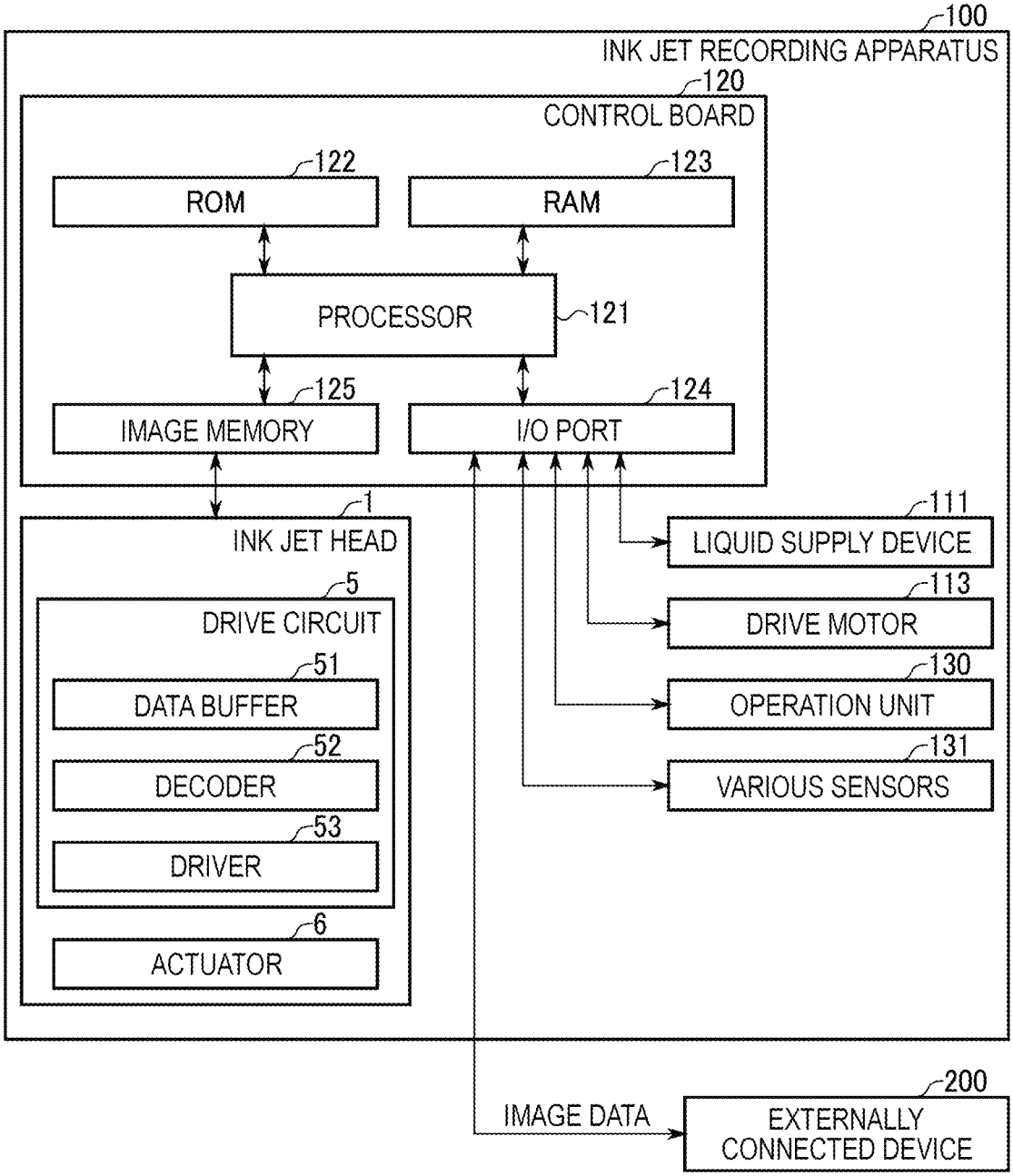
FIG. 6 is a block diagram illustrating a configuration of an ink jet printing apparatus.

FIG. 6 is a block diagram illustrating an example of the configuration of the ink jet printing apparatus 100. On a control board 120, a processor 121, a ROM 122, a RAM 123, an I/O port 124 (which is a data input and output port), and an image memory 125 are mounted. The control board 120 may be referred to as a controller or a control unit in some contexts. The processor 121 controls a drive motor 113, the liquid supply device 111, an operation unit 130, and various sensors 131 through signals and commands transmitted via the I/O port 124. Printing data from an externally connected device 200 is transmitted to the control board 120 through the I/O port 124 and stored in the image memory 125. The processor 121 transmits the printing data stored in the image memory 125 to the drive circuit 5 in a drawing (printing) order.

The drive circuit 5 includes a data buffer 51, a decoder 52, and a driver 53. The data buffer 51 stores printing data for each actuator 6 in time series. The decoder 52 controls the driver 53 for each actuator 6 based on the printing data stored in the data buffer 51. The driver 53 outputs a drive signal for operating each actuator 6 under the control of the decoder 52. The drive signal is a voltage applied to each actuator 6.

In the following, an operation of the ink jet head 1 according to the embodiment will be described with reference to FIGS. 7 and 8.

Figure 7:
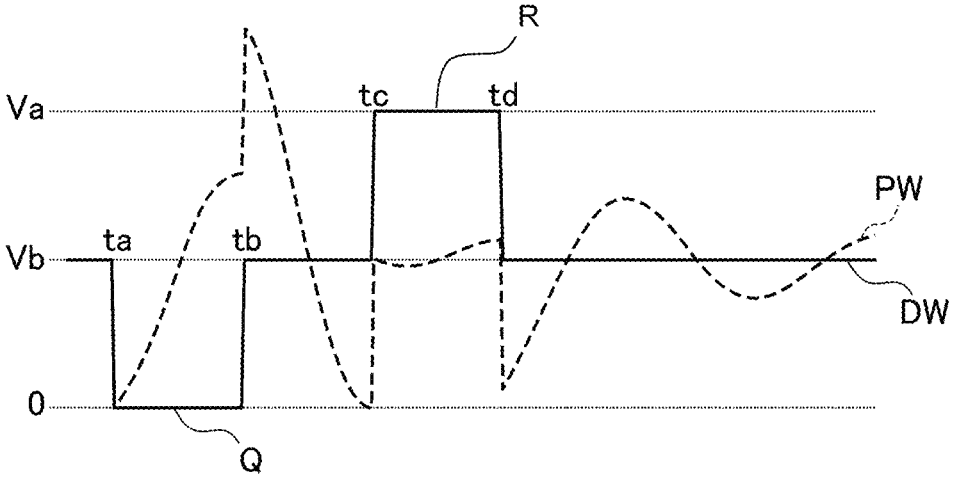
FIG. 7 is a waveform diagram illustrating an example of a normal drive waveform.

FIG. 7 is a waveform diagram illustrating an example of a normal drive waveform. FIG. 8 is a diagram for illustrating a pressure change of ink in the pressure chamber 20 of the ink jet head 1 driven by the drive waveform of FIG. 7. In FIG. 7, a drive waveform DW (indicated by a solid line) illustrates the waveform of the drive signal. A pressure waveform PW (indicated by a broken line) illustrates pressure of the ink in the pressure chamber 20. FIG. 8 is an explanatory diagram illustrating aspects related an ink droplet formation when the ink jet head 1 is driven by the drive signal of FIG. 7.

Figure 8:
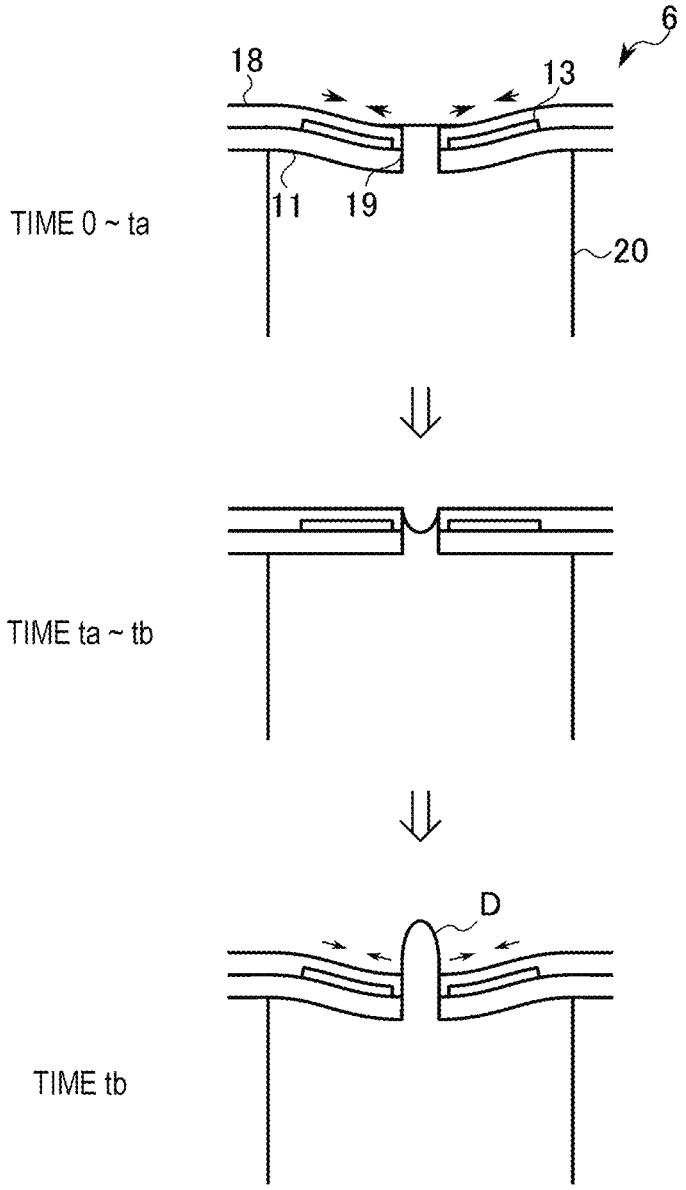
FIG. 8 is a diagram for illustrating aspects related to a pressure change in a pressure chamber of an ink jet head driven by the drive waveform of FIG. 7.

The actuator 6 illustrated in FIG. 8 constantly generates a standby potential Vb in the piezoelectric body 13 at steady state (resting state). When the drive signal of the drive waveform DW in FIG. 7 is supplied from a drive IC 3 to the ink jet head 1, at time ta, the common electrode 8 and the common electrode 9 are both grounded, and an expansion pulse Q of the ground potential GND (0 V) is applied to the individual electrode 7. Then, as illustrated in FIG. 8, a volume of the pressure chamber 20 is increased from the standby state volume, thus the pressure in the pressure chamber 20 is decreased, and the ink flows from an ink flow path 42 into the pressure chamber 20.

The application time of the expansion pulse Q is 1 acoustic length (AL) between time ta and time tb. The acoustic length (AL) is the time it takes for a pressure wave caused by ink flowing into the pressure chamber 20 after the volume increased to propagate through the entire pressure chamber 20 and reach the nozzle 19. That is, the acoustic length (AL) is ½ of an acoustic resonance period of the pressure chamber 20. The AL is determined by the structure and shape of the ink jet head 1, density of the ink, and the like.

At time tb in FIG. 7, the voltage applied to the individual electrode 7 of the pressure chamber 20 is returned to the standby potential Vb. Then, the ink in the pressure chamber 20 is compressed, and an ink droplet D is ejected from the corresponding nozzle 19.

Then, the pressure in the pressure chamber 20 starts to decrease due to the ejecting of the ink. When 1 AL elapses after the ejection, application of a compression pulse R of a voltage Va is started at time tc when the pressure exceeds the normal pressure and reaches the peak of negative pressure. The application time of the compression pulse R is 1 AL from time tc to time td. With such configuration, a pressurizing force is generated on the ink within the pressure chamber 20 after the ink droplet ejection to suppress the decrease in the ink pressure and dampen vibration of the ink. By dampening vibration as such, the next ejection operation can be more stably performed. The values of voltage Va and the voltage Vb, which are drive voltages, can be changed.

The pulse waveform for ejecting ink is not limited to unipolar driving in which only a positive potential is included. For example, the ink jet head 1 may be subjected to bipolar driving in which the standby potential applied to the individual electrode 7 of the pressure chamber 20 is the ground potential GND, the expansion pulse Q is a negative potential, and the compression pulse R is a positive potential.

Figure 9:
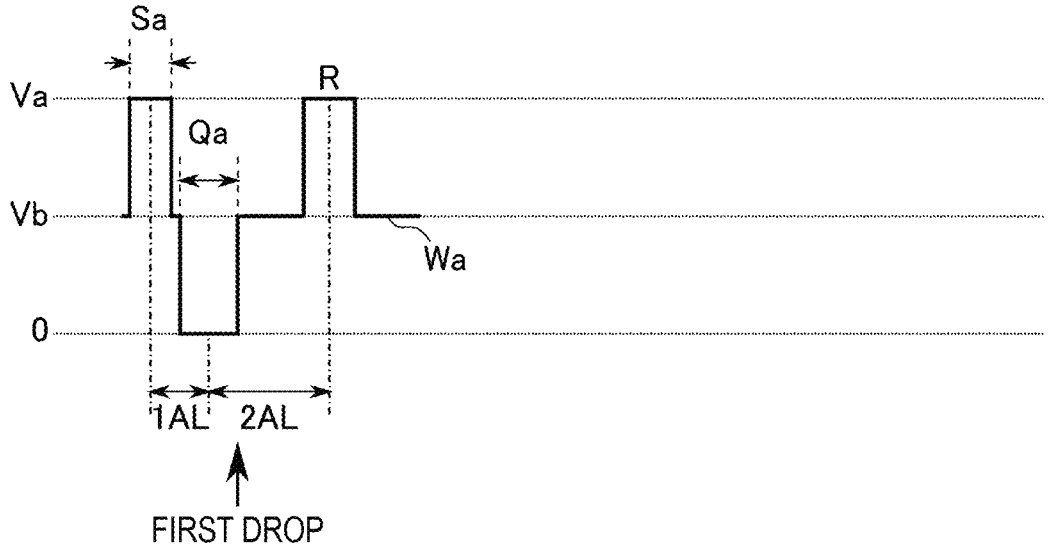
FIG. 9 is a waveform diagram illustrating a drive waveform for a single drop ejection.
Figure 10:
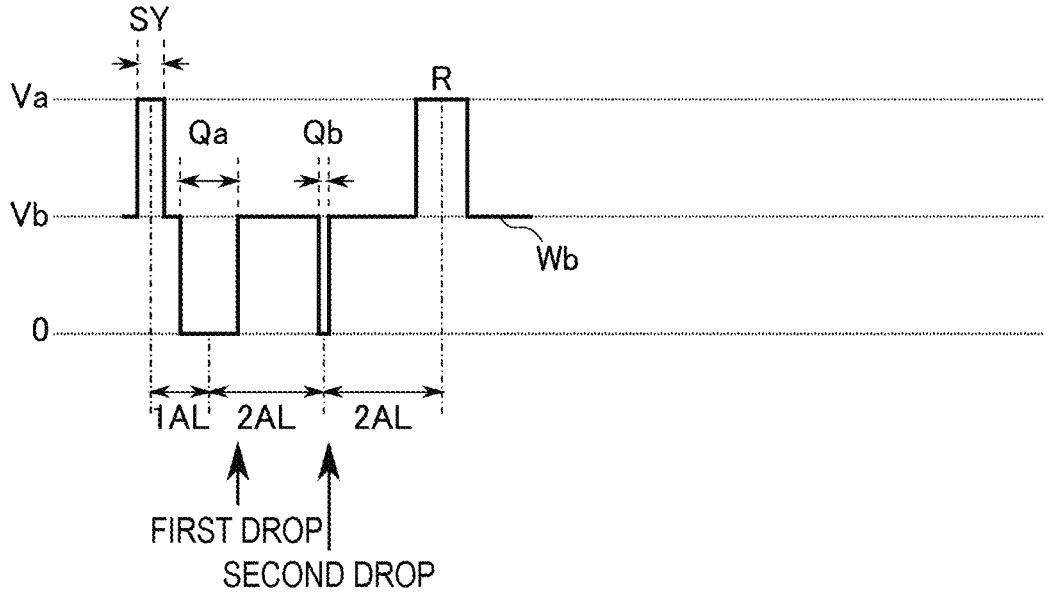
FIG. 10 is a waveform diagram illustrating a drive waveform of a multi-drop ejection (two drops).
Figure 11:
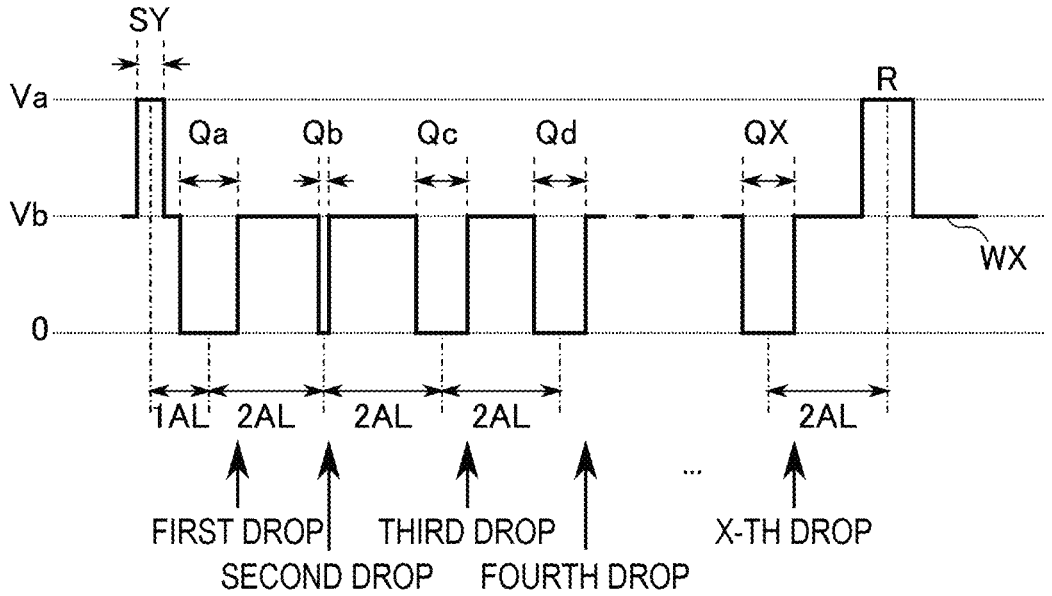
FIG. 11 is a waveform diagram illustrating a drive waveform of a multi-drop ejection (X drops).

Subsequently, with reference to FIGS. 9 to 11, drive waveforms of single drop type and multi-drop type input to the actuator 6 in one drive cycle will be described. In this context, single drop type means that the number of droplet ejections times one, and multi-drop type means that the number of droplets ejection times is more than one. FIG. 9 is a waveform diagram illustrating a drive waveform Wa of a single-drop type. FIG. 10 is a diagram illustrating a drive waveform drive Wb of a multi-drop type in which the number of ejections is two. FIG. 11 is a diagram illustrating a drive waveform WX of multi-drop type in which the number of ejections is X, where X is an integer of 3 or more. The drive waveform. Wa is an example of the waveform of the first drive signal. The drive waveforms Wb and WX are examples of the waveform of the second drive signal.

The drive waveform Wa illustrated in FIG. 9 includes an auxiliary pulse Sa, an expansion pulse Qa, and the compression pulse R. When one drop is to be ejected by the single drop method, an auxiliary pulse signal is applied before applying the expansion pulse. The auxiliary pulse signal is not sufficient by itself to cause a droplet to be ejected from the nozzle.

The auxiliary pulse Sa is applied to generate a preliminary vibration in the pressure chamber 20 for promoting ejection of ink. The time from the center of the auxiliary pulse Sa to the center of the expansion pulse Qa is 1 AL, for example. In this context, the center of a pulse is the center time point between the start and end of application of the pulse. The wider the pulse width of the auxiliary pulse Sa, the greater the change in the volume of the pressure chamber 20 and the higher the ejection speed. The pulse width of the auxiliary pulse Sa is, for example, 0.2 AL to 0.4 AL.

The expansion pulse Qa is applied to eject ink from the nozzle 19.

The drive waveform Wb illustrated in FIG. 10 includes an auxiliary pulse SY, the expansion pulse Qa, an expansion pulse Qb, and a compression pulse R. The drive waveform. WX illustrated in FIG. 11 includes the auxiliary pulse SY, the expansion pulses Qa, Qb, Qc, Qc . . . QX and the compression pulse R. The expansion pulses Qa, Qb, . . . QX are applied to eject ink from the nozzle 19. When two or more drops are ejected by the multi-drop method, the expansion pulses are repeated such that the center-to-center spacing from one expansion pulse to the next is equal to 2 AL. In FIG. 11, the X-th expansion pulse is illustrated as QX. From the viewpoint of simplifying control, the expansion pulses Qc, Qd, . . . QX preferably all have the same pulse width. For a drive signal of two drops or more, the peak of negative pressure is after the end of application of the expansion pulse Qa, and the next expansion pulse is applied. With such configuration, the increase in the ink pressure due to the end of the application of the expansion pulse Qb and the increase in the ink pressure due to the pressure waveform overlap, the change in the ink pressure is amplified, and the ejection speed of ink droplet at second and subsequent drops becomes faster than that of the first drop. The pulse widths of the expansion pulse Qb and the expansion pulse QX are preferably both shorter than the pulse width of the expansion pulse Qa (that is, preferably, Qb<Qa and QX<Qa). This is to reduce a flight speed of the ink droplet during the multi-drop process and bring the ejection speed during the multi-drop process closer to that of the ink droplet during the single drop process.

The auxiliary pulse SY is applied to generate preliminary vibration in the pressure chamber 20 for promoting ejection of ink. The time from the center of the auxiliary pulse SY to the center of the expansion pulse Qa is, for example, 1 AL, as was the case for the auxiliary pulse Sa. The pulse width of the auxiliary pulse SY (Y≥2) can be variable. Since the inkjet head 1 can change both the driving voltage and the pulse width, the ink can be more stably ejected. The ink ejected at high speed eventually becomes one droplet and lands on the image forming medium S. As described above, in ejecting two or more drops, pulse widths are arranged such that the flight speed of ink droplet is reduced to make the ejection speed in ejecting two or more drops equal to that of one drop that ejected with the single drop. Accordingly, the pulse width of the auxiliary pulse SY is preferably shorter than that of auxiliary pulse Sa in one drop ejection (SY<Sa). The pulse width of the auxiliary pulse SY is, for example, 0.1 AL to 0.3 AL.

However, the drive IC 3 generally places a limitation on the pulse width of the auxiliary pulse that can be generated depending on the performance related to the rise and fall times of the potential. Accordingly, when the minimum pulse width that can be generated by the drive IC 3 is Smin, the pulse width (Sa) of the auxiliary pulse Sa and the pulse width (SY) of the auxiliary pulse SY preferably satisfy a relationship of Sa>SY Smin≥0.

The expansions pulses Qa, Qb, . . . QX are examples of ejection pulses. The expansion pulse Qa is a first ejection pulse; the expansion pulse Qb is a second ejection pulse; the expansion pulse QX is the X-th ejection pulse.

Specific Example

The present specific example ("Specific Example") does not limit the scope of the embodiment.

In the ink jet head 1 of the Specific Example, the following values are utilized: Va=20 V, Vb=10 V, Qa=1 AL, Qb=0.28 AL, Qc, Qd, . . . QX=0.37 AL, Sa=0.26 AL, SY=0.17 AL.

Figure 12:
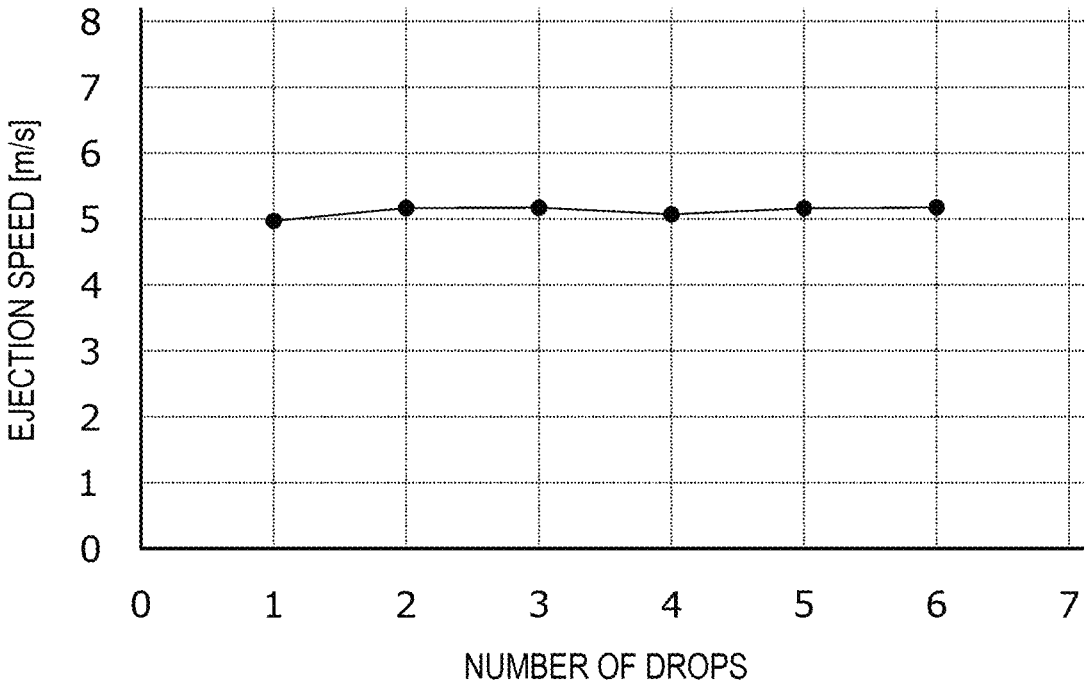
FIG. 12 is a graph illustrating an ejection speed with respect to the number of drops in Example.
Figure 13:
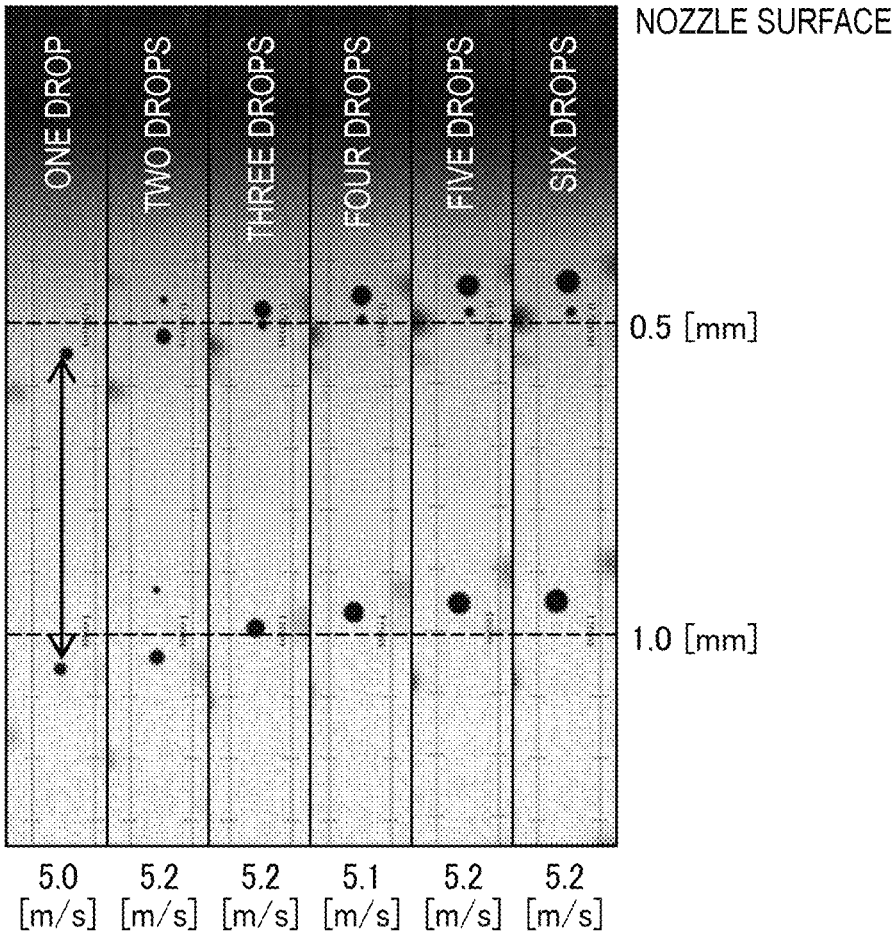
FIG. 13 depicts a state of ink droplet flight for different numbers of drops.

By using the ink jet head 1 of Specific Example and applying the drive waveforms for one to six droplets (i.e., drive waveform Wa (one drop) to drive waveform Wf (drive waveform WX with X=f, that is 6 ejection pulses)) at a frequency of 10 kHz, the ejection was performed with the number of ejections being 1 drop to 6 drops. The ejection speed for each number of drops here is illustrated in the graph of FIG. 12. FIG. 12 is a graph illustrating the ejection speed with respect to each number of drops in Specific Example. FIG. 13, depicts an image of flight states of ink droplets for each number of droplets (one to six). FIG. 13 is a drawing-substitute corresponding to photographs of ink droplets in flight.

As illustrated in FIG. 12 and FIG. 13, the fact that the ejection speeds for the different number of droplets are almost the same regardless of the number of droplet ejections can be seen. Accordingly, the fact that the ink jet head 1 of the present embodiment is capable of more stable ejection can be seen.

The embodiment described above can be modified in various ways.

In the embodiment described above, the pulse width of the auxiliary pulse Sa was 0.2 AL to 0.4 AL and the pulse width of the auxiliary pulse SY was 0.1 to 0.3 AL, but the values are merely examples and should not be construed as preferable values. The values may change depending on the ink characteristics and the like, and appropriate values can be set for the ink jet head 1 accordingly.

In addition to the embodiment described above, the ink jet head 1 may have, for example, a structure in which a diaphragm is deformed by static electricity to eject ink, or a heating element type structure in which ink is ejected from the nozzle by utilizing thermal energy from a heater or the like. Here, the diaphragm, the heater, or the like is considered an actuator for generating a pressure vibration inside the pressure chamber 20.

In the ink jet head 1 of the embodiment, the arrangement of the actuators may be different from that described above. For example, the ink jet head 1 may have a configuration in which two actuators sandwich a pressure chamber.

The ink jet printing apparatus 100 of an embodiment is an ink jet printer that forms a two-dimensional image with ink on the image forming medium S. However, the ink jet printing apparatus 100 is not limited thereto. The ink jet printing apparatus 100 in other embodiments may be, for example, a 3D printer, an industrial manufacturing machine, or a medical instrument. When the ink jet printing apparatus 100 is a 3D printer, an industrial manufacturing machine, a medical instrument, or the like, the ink jet printing apparatus 100 forms a three-dimensional object by ejecting a substance to be used as a material or a binder for hardening the material from an inkjet head, for example.

The ink jet printing apparatus 100 included four ink jet heads 1, and colors of the ink used by the ink jet heads 1 were cyan, magenta, yellow, or black, respectively. However, the number of ink jet heads 1 included in the ink jet printing apparatus is not limited to four, and may be just one. Furthermore, the color and characteristics of ink used by each ink jet head 1 are not limited.

The ink jet head 1 can also eject a transparent glossy ink, an ink that develops color when irradiated with infrared rays or ultraviolet rays, other special ink types, or the like. Furthermore, the ink jet head 1 may be capable of ejecting liquid other than ink. The liquid ejected by the ink jet head 1 may be dispersion liquid such as suspension liquid. The liquid ejected by the ink jet head 1 includes, for example, liquid containing conductive particles for forming a wiring pattern on a printed wiring board, liquid containing cells for artificially forming a tissue or an organ, a binder such as an adhesive, a wax, or a liquid resin, and the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid ejection head, comprising:

a pressure chamber configured to contain a liquid;

an actuator configured to change pressure of the pressure chamber according to an applied drive signal; and a drive circuit configured to apply a first drive signal to the actuator when a single droplet is to be ejected from the pressure chamber and apply a second drive signal to the actuator when two or more droplets are to be ejected in series from the pressure chamber, wherein the first drive signal includes a first auxiliary pulse before a first ejection pulse, the second drive signal includes a second auxiliary pulse before the first ejection pulse, a pulse width of the first auxiliary pulse being greater than a pulse width of the second auxiliary pulse, and a pulse width of a second ejection pulse in the second drive signal is less than a pulse width of the first ejection pulse.

2. The liquid ejection head according to claim 1, wherein, in the second drive signal, pulse widths of subsequent ejection pulses after the second ejection pulse are less than the pulse width of the first ejection pulse.

3. The liquid ejection head according to claim 2, wherein, in the second drive signal, the pulse widths of subsequent ejection pulses after the second ejection pulse are greater than the pulse width of the second ejection pulse.

4. The liquid ejection head according to claim 3, wherein, in the second drive signal, the pulse widths of subsequent ejection pulses after the second ejection pulse are equal to one another.

5. The liquid ejection head according to claim 2, wherein, in the second drive signal, the pulse widths of subsequent ejection pulses after the second ejection pulse are equal to one another.

6. The liquid ejection head according to claim 1, wherein the second drive signal includes four or more ejection pulses, a pulse width of the third ejection pulse in the second drive signal is greater than the pulse width of the second ejection pulse, but less than the pulse width of the first ejection pulse in the second drive signal, and pulse widths of the third and subsequent ejection pulses are equal to each other.

7. The liquid ejection head according to claim 1, wherein the drive circuit is configured to vary a drive voltage of the first and second drive signals, and the drive circuit is configured to vary the pulse widths of the first and second auxiliary pulses.

8. The liquid ejection head according to claim 1, wherein the actuator is piezoelectric.

9. A liquid ejection apparatus, comprising:

a pressure chamber configured to contain a liquid;

a liquid supply device configured to supply the liquid to the pressure chamber;

an actuator configured to change pressure of the pressure chamber according to an applied drive signal; and a drive circuit configured to apply a first drive signal to the actuator when a single droplet is to be ejected from the pressure chamber and apply a second drive signal to the actuator when two or more droplets are to be ejected in series from the pressure chamber, wherein the first drive signal includes a first auxiliary pulse before a first ejection pulse, the second drive signal includes a second auxiliary pulse before the first ejection pulse, a pulse width of the first auxiliary pulse being greater than a pulse width of the second auxiliary pulse, and a pulse width of a second ejection pulse in the second drive signal is less than a pulse width of the first ejection pulse.

10. The liquid ejection apparatus according to claim 9, wherein, in the second drive signal, pulse widths of subsequent ejection pulses after the second ejection pulse are less than the pulse width of the first ejection pulse.

11. The liquid ejection apparatus according to claim 10, wherein, in the second drive signal, the pulse widths of subsequent ejection pulses after the second ejection pulse are greater than the pulse width of the second ejection pulse.

12. The liquid ejection apparatus according to claim 11, wherein, in the second drive signal, the pulse widths of subsequent ejection pulses after the second ejection pulse are equal to one another.

13. The liquid ejection apparatus according to claim 10, wherein, in the second drive signal, the pulse widths of subsequent ejection pulses after the second ejection pulse are equal to one another.

14. The liquid ejection apparatus according to claim 9, wherein the second drive signal includes four or more ejection pulses, a pulse width of the third ejection pulse in the second drive signal is greater than the pulse width of the second ejection pulse, but less than the pulse width of the first ejection pulse in the second drive signal, and pulse widths of the third and subsequent ejection pulses are equal to each other.

15. The liquid ejection apparatus according to claim 9, wherein the actuator is piezoelectric.

16. A inkjet printer, comprising:

an inkjet head including a pressure chamber configured to contain an ink;

an ink cartridge configured to supply the ink to the inkjet head;

an actuator configured to change pressure of the pressure chamber according to an applied drive signal; and a drive circuit configured to apply a first drive signal to the actuator when a single droplet is to be ejected from the pressure chamber and apply a second drive signal to the actuator when two or more droplets are to be ejected in series from the pressure chamber, wherein the first drive signal includes a first auxiliary pulse before a first ejection pulse, the second drive signal includes a second auxiliary pulse before the first ejection pulse, a pulse width of the first auxiliary pulse being greater than a pulse width of the second auxiliary pulse, and a pulse width of a second ejection pulse in the second drive signal is less than a pulse width of the first ejection pulse.

17. The inkjet printer according to claim 16, wherein, in the second drive signal, pulse widths of subsequent ejection pulses after the second ejection pulse are less than the pulse width of the first ejection pulse, but greater than the pulse width of the second ejection pulse.

18. The inkjet printer according to claim 17, wherein, in the second drive signal, the pulse widths of subsequent ejection pulses after the second ejection pulse are greater than the pulse width of the second ejection pulse.

19. The inkjet printer according to claim 18, wherein, in the second drive signal, the pulse widths of subsequent ejection pulses after the second ejection pulse are equal to one another.

20. The inkjet printer according to claim 16, wherein the drive circuit is configured to vary a drive voltage of the first and second drive signals, and the drive circuit is configured to vary the pulse widths of the first and second auxiliary pulses.

* * * * *